US007106042B1

(12) United States Patent
Jackson

(10) Patent No.: US 7,106,042 B1
(45) Date of Patent: Sep. 12, 2006

(54) REPLICA BIAS REGULATOR WITH SENSE-SWITCHED LOAD REGULATION CONTROL

(75) Inventor: Scott A. Jackson, Apex, NC (US)

(73) Assignee: Cypress Semiconductor Corporation, San Jose, CA (US)

( * ) Notice: Subject to any disclaimer, the term of this patent is extended or adjusted under 35 U.S.C. 154(b) by 0 days.

(21) Appl. No.: 11/004,564

(22) Filed: Dec. 3, 2004

Related U.S. Application Data

(60) Provisional application No. 60/527,150, filed on Dec. 5, 2003.

(51) Int. Cl.
*G05F 3/16* (2006.01)

(52) U.S. Cl. ..... 323/316; 323/275; 323/280

(58) Field of Classification Search ..... 323/273, 323/274, 277, 304, 311–316
See application file for complete search history.

(56) References Cited

U.S. PATENT DOCUMENTS

| | | | | |
|---|---|---|---|---|
| 5,661,395 | A * | 8/1997 | Johnson et al. | 323/273 |
| 6,157,178 | A | 12/2000 | Montanari | |
| 6,249,177 | B1 | 6/2001 | Savage | |
| 6,373,231 | B1 | 4/2002 | Lacey | |
| 6,424,131 | B1 * | 7/2002 | Yamamoto et al. | 323/282 |
| 6,441,593 | B1 | 8/2002 | Saripella | |
| 6,601,936 | B1 | 8/2003 | McDonald | |
| 2005/0134242 | A1 | 6/2005 | Gradinariu | |

* cited by examiner

*Primary Examiner*—Gary L Laxton
(74) *Attorney, Agent, or Firm*—Brownstein Hyatt & Farber, P.C.

(57) ABSTRACT

A regulator circuit including output loading sense circuitry where the output loading sense circuitry comprises, in one example, a resistor in the feedback leg of the replica bias regulator, a switch in the feedback leg of the replica bias regulator for bypassing the resistor, and a comparator used to sense the output loading and selectively drive the switch.

15 Claims, 2 Drawing Sheets

REPLICA BIAS REGULATOR WITH SENSE-SWITCHED LOAD REGULATION CONTROL

CROSS REFERENCE TO RELATED APPLICATION

This application claims priority under 35 U.S.C. 119(e) to U.S. Provisional Patent Application No. 60/527,150 entitled "Replica Bias Regulator with Sense-Switched Load Regulation Control" filed Dec. 5, 2003, the disclosure of which is hereby incorporated by reference in its entirety.

FIELD OF THE INVENTION

The present invention relates generally to electronic circuits and in particular to circuits for replica bias regulation.

BACKGROUND OF THE INVENTION

A replica bias regulator is a regulator that isolates the output of the regulator from the feedback loop of the regulator. This is done to ensure stability of the feedback loop of the overall regulator. If the output node was in the loop, the loop could become unstable due to widely varying and unpredictable currents drawn by the load. The output voltage is then designed to be a replica (copy) of the voltage formed in the feedback loop that does not have varying current.

A conventional replica bias regulator 10 is shown in FIG. 1 and comprises a simple replica bias regulator that has no adjustment for load regulation. In the conventional replica bias regulator of FIG. 1, the output signal (Vout) is taken from a replica output that is not connected in the feedback loop, thus isolating the output capacitance and load current from the feedback loop and ensuring stability of the overall circuit. As recognized by the present inventor, the problem with this architecture is the large load regulation that results from the change in voltage at this node due to a change in current. The output voltage drops as more current is pulled from the output. With large ranges of output currents, this architecture may not meet the output voltage requirements for all desired operating conditions. This phenomena is illustrated in FIG. 2.

FIG. 2 shows the output waveform with respect to load current of the conventional replica bias regulator for FIG. 1. The graph shows the output voltage (Vout) falling as the output current (Iout) increases. This is due to the increased gate-source voltage (Vgs) of the output transistor M2 required to supply the load current. Also shown is the line indicating the source voltage of transistor M1. This is the reference voltage set by feedback. The output waveform Vout moves around this reference/source voltage of M1 depending on the load current. The lower dashed horizontal line 12 represents the lower specified limit of Vout for the application. As the graph shows with the line 12, there is a maximum Iout that can be sourced before the output signal Vout falls below the specified limit across line 12. Conversely, if the output current drops (i.e., during a sleep mode or other low current mode), then the Vout signal rises above the specified limit shown by line 14.

One solution for this problem is to increase the size of the output transistor M2 to allow more current drive. However, when doing this, a new problem is created. The larger the transistor M2, the more sub-threshold current it sinks. This will cause the output to drift upward above the upper specification limit when very little or zero current is required from the regulator. This range of problems effects applications where large ranges of current are required such as those with standby modes and active modes.

As recognized by the present inventor, what is needed is a replica bias regulator that provides an output voltage characteristic that stays within the specified limits for all possible load currents that the regulator will have to supply.

It is against this background that various embodiments of the present invention were developed.

SUMMARY

In light of the above and according to one broad aspect of one embodiment of the present invention, disclosed herein is a circuit including a replica bias regulator having a feedback leg and an output voltage and output loading sense circuitry. In one example, the output loading sense circuitry may include a resistor in the feedback leg of the replica bias regulator; a switch in the feedback leg of the replica bias regulator, the switch for selectively bypassing the resistor; and a comparator used to sense the output voltage and selectively drive the switch.

In one example, when the output voltage is drifting high, the comparator is on and drives the switch closed which bypasses the resistor, thereby removing the resistor from the feedback leg. In another example, when the output voltage is drifting low, the comparator is off and the switch is open which maintains the resistor in the feedback leg.

In one embodiment, the replica bias regulator includes at least a pair of n-channel transistors. The comparator may include internal hysteresis. In one example, the replica bias regulator includes an error amplifier comparing a reference signal to a feedback signal and providing an output.

In another example, the replica bias regulator may include a first transistor having a drain coupled with a supply, a drain receiving the output of the error amplifier, and a source coupled with the switch. The switch may be an n-channel transistor. The feedback circuit may include at least one resistor when the switch is on, and in another example, the feedback circuit may include at least two resistors when the switch is off.

According to another broad aspect of another embodiment of the present invention, disclosed herein is a method of performing load regulation in a circuit. In one example, the method includes sensing a level of an output load current; and in response to the sensing operation, altering a feedback resistance in the replica bias circuit.

In one example, the altering operation may include bypassing a portion of the feedback resistance if the output load current is low, including a portion of the feedback resistance if the output load current is high.

According to another broad aspect of another embodiment of the present invention, disclosed herein is a circuit for performing load regulation of an output, comprising means for sensing a level of an output load current; and means for altering a feedback resistance in a replica bias circuit responsive to the sensing means. In one example, the means for altering may include means for bypassing a portion of the feedback resistance if the output load current is low, or may include means for including a portion of the feedback resistance if the output load current is high. The means for bypassing may include a comparator coupled with a switch.

The features, utilities and advantages of the various embodiments of the invention will be apparent from the following more particular description of embodiments of the invention as illustrated in the accompanying drawings.

DETAILED DESCRIPTION

Figure 1:
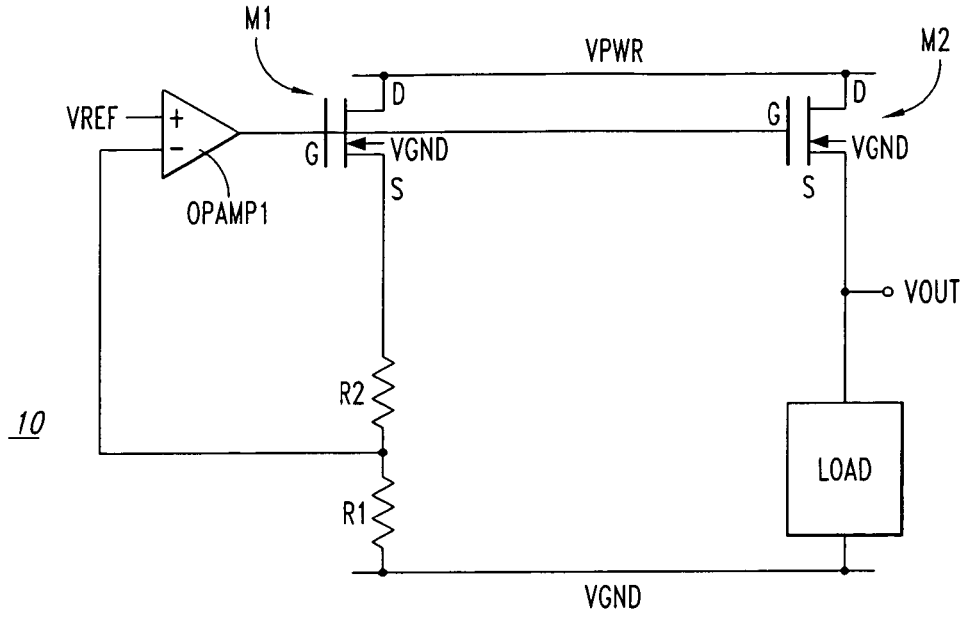
Fig. 1 (Prior Art)
FIG. 1 is a conventional replica bias regulator.
Figure 2:
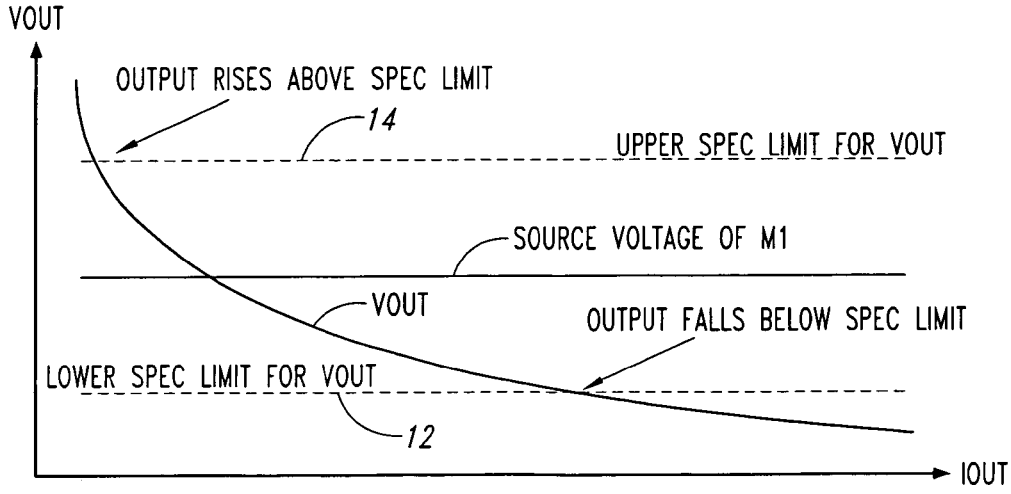
Fig. 2 (Prior Art)
FIG. 2 is an output load regulation waveform of the conventional replica bias regulator of FIG. 1.
Figure 3:
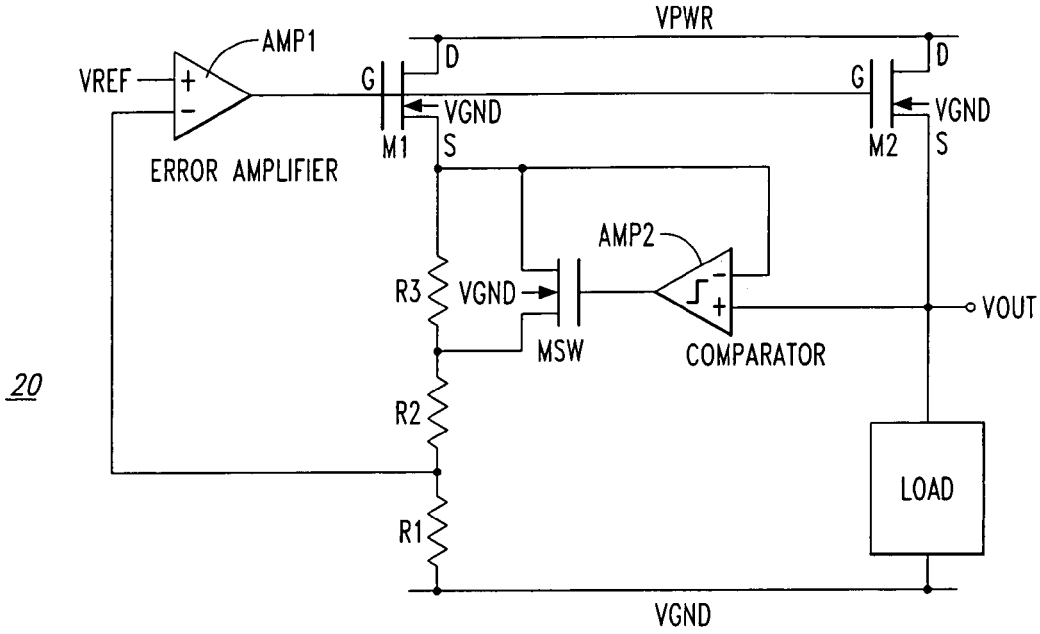
FIG. 3 is an example of a replica bias regulator in accordance with one embodiment of the present invention.

An example of an improved replica bias regulator 20 is shown in FIG. 3 in accordance with one embodiment of the present invention. This improved replica bias regulator includes circuitry to increase the range of load current the regulator can handle while staying within output voltage specification requirements. Various embodiments of the present invention will now be described.

In the example of FIG. 3, N-channel transistors M1 and M2 each have their drains coupled with a supply Vpwr and the gates of both transistors M1 and M2 are coupled with the output of amplifier AMP1 (i.e., an error amplifier). Amplifier AMP1 receives at its input a reference voltage, as well as a signal derived from the series combination of resistors R2, R1 which are coupled between the source of transistor M1 and ground. The source of transistor M2 is coupled with the load, and the source of transistor M2 provides the output voltage shown as Vout.

Further, resistor R3 is coupled between the source of transistor M1 and resistor R2. Amplifier AMP2 (i.e. a comparator or differential amplifier) has its non-inverting input coupled with the output voltage VOUT (which is the source voltage of transistor M2 across the load). The inverting input of amplifier AMP2 is coupled with the source of transistor M1, as well as the drain of N-channel MOSFET switch Msw which provides a switch between R2 to the source of transistor M1. The gate of transistor Msw is coupled with the output of amplifier/comparator AMP2. Comparator AMP2 may be provided with internal hysteresis if desired.

A feedback loop is formed including resistors R1, R2, R3 and transistor M1, and switch Msw. When Msw is activated, this alters the feedback loop as resistor R3 is controllably removed from the feedback loop by Msw. In this way, resistor R3, comparator AMP2 and a MOSFET switch Msw provide the replica bias regulator with a greater output load current range while maintaining the overall output voltage Vout within specified operational limits.

As to the upper limit of output voltage, the output of the reference transistor M1 can be set to a lower voltage thereby setting the gate of the replica transistor M2 to a lower voltage. This keeps the output voltage Vout from exceeding the upper specification limit when small amounts of current are drawn by the load.

Specifically, for low values of current drawn from the regulator in FIG. 3, Vout is a higher voltage than the source of M1. When Vout is higher than the source voltage of transistor M1, resistor R3 is shorted or bypassed so that the voltage across R3 is approximately 0V. The resulting feedback action of the error amplifier forces the voltage at the source of M1 to be at a value which forces the gate voltage of M1 and M2 to be low enough to prevent Vout from being pulled up beyond the upper specified limit.

When significant current is drawn from the regulator, Vout will be pulled low, eventually dropping below the voltage at the source of transistor M1. When this happens, resistor R3 is connected in series with resistors R2 and R1 causing the feedback to raise the gate voltage of transistors M1 and M2. The rise in gate voltage then allows more current to be drawn from Vout before it falls below its specified lower limit.

Figure 4:
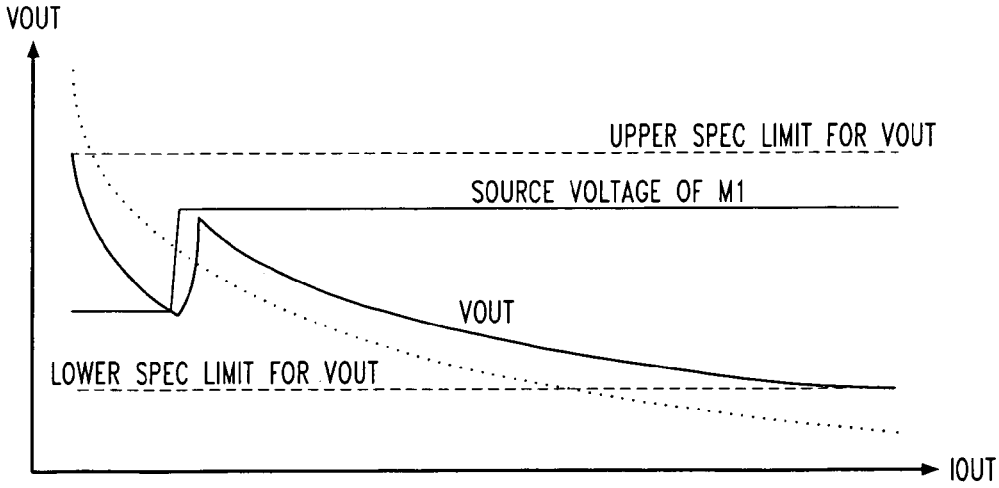
FIG. 4 is an example of an output load regulation waveform of the replica bias regulator of FIG. 3, in accordance with an embodiment of the present invention.

FIG. 4 shows an example waveform of the output Vout of the circuit of FIG. 3 with respect to load current Iout. In effect, for low output currents (such as during a sleep mode or other low current mode), the circuit of FIG. 3 shifts the Vout waveform downwardly so that Vout does not exceed the upper specification limit. Stated differently, when a low amount of current Iout is being pulled from the output node, the output voltage Vout climbs towards the upper specification limit as shown in FIG. 4. When the Vout node voltage is higher than the voltage at the source of transistor M1, the comparator AMP2 turns on and switch Msw turns on effectively shorting or bypassing resistor R3. In this mode, the feedback loop of the circuit including the error amplifier AMP1, transistor M1, resistors R1, R2 will then force the source voltage of M1 to a lower voltage. This will in turn force the gate voltage of M1 and M2 to a lower voltage which will prevent the output node voltage Vout from drifting above the upper specification limit. Now, as an increasing load current is pulled from the output, it will reach a point where the Vout node voltage drops below the source voltage of M1. When this occurs, the comparator AMP2 switches turning off Msw which introduces resistor R3 into the feedback loop. This causes the source voltage of M1 and the gate voltage of M1 and M2 to shift upward, which thereby shifts the output voltage upward adding margin to the lower specification limit. Hence, in one example. this process has built in hysteresis. The hysteresis occurs because when R3 is either switched in or out, the feedback action of the loop pulls all node voltages in a direction that aids in the switching process.

Hence, it can be seen that a replica bias regulator made according to embodiments of the present invention can effectively provide greater currents to loads while maintaining the output voltage Vout within acceptable operating ranges. The extended output current range allows the regulator to be used in applications that require little or no current during a standby condition, and large currents in an active condition.

The hysterisis of an embodiment of the invention is advantageous because it adds noise immunity to the loop comprising the comparator. In one example, the hysteresis arises from the source of M1 also being pulled upward when resistor R3 is switched in by Msw. This increases the margin between the source of M1 and Vout and keeps R3 switched in.

An alternate solution that can be constructed using this method is to add multiple resistors, switches, or comparators in series with R1 and R2 allowing multiple switching points. This will allow smaller output transistors to be used.

In alternate embodiments, the switch Msw can be replaced with any type of switch device. In another alternate embodiment, the comparator can be any type of comparator including conventional comparators, and the resistor R3 can be replaced with any device that can be operated as a resistor such as a transistor or any device that can force a voltage drop to occur. Another alternate embodiment is to remove the comparator and switch the gate of Msw with a standby enable signal which would be high during a standby condition and low during an active condition.

Embodiments of the present invention may be used in various semiconductors, memories, processors, controllers, integrated circuits, logic or programmable logic, clock circuits, communications devices, and the like.

It is understood that the term "transistor" or "switch" as used herein includes any switching element which can include, for example, n-channel or p-channel CMOS transistors, MOSFETs, FETs, JFETS, BJTs, or other like switching element or device. The particular type of switching element used is a matter of choice depending on the particular application of the circuit, and may be based on factors such as power consumption limits, response time, noise immunity, fabrication considerations, etc. Hence while embodiments of the present invention are described in terms of p-channel and n-channel transistors, it is understood that other switching devices can be used, or that the invention may be implemented using the complementary transistor types.

While the methods disclosed herein have been described and shown with reference to particular operations performed in a particular order, it will be understood that these operations may be combined, sub-divided, or re-ordered to form equivalent methods without departing from the teachings of the present invention. Accordingly, unless specifically indicated herein, the order and grouping of the operations is not a limitation of the present invention.

It should be appreciated that reference throughout this specification to "one embodiment" or "an embodiment" or "one example" or "an example" means that a particular feature, structure or characteristic described in connection with the embodiment may be included, if desired, in at least one embodiment of the present invention. Therefore, it should be appreciated that two or more references to "an embodiment" or "one embodiment" or "an alternative embodiment" or "one example" or "an example" in various portions of this specification are not necessarily all referring to the same embodiment. Furthermore, the particular features, structures or characteristics may be combined as desired in one or more embodiments of the invention.

Similarly, it should be appreciated that in the foregoing description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed inventions require more features than are expressly recited in each claim. Rather, as the following claims reflect, inventive aspects lie in less than all features of a single foregoing disclosed embodiment, and each embodiment described herein may contain more than one inventive feature.

While the invention has been particularly shown and described with reference to embodiments thereof, it will be understood by those skilled in the art that various other changes in the form and details may be made without departing from the spirit and scope of the invention.

What is claimed is:

1. A circuit, comprising:

a replica bias regulator having a feedback leg and an output voltage; and output loading sense circuitry, where the output loading sense circuitry comprises:

a resistor in the feedback leg of the replica bias regulator;

a switch in the feedback leg of the replica bias regulator, the switch for selectively bypassing the resistor; and a comparator used to sense the output voltage and selectively drive the switch.

2. The circuit of claim 1, wherein when the output voltage is drifting high, the comparator is on and drives the switch closed which bypasses the resistor, thereby removing the resistor from the feedback leg.

3. The circuit of claim 1, wherein when the output voltage is drifting low, the comparator is off and the switch is open which maintains the resistor in the feedback leg.

4. The circuit of claim 1, wherein the replica bias regulator includes at least a pair of n-channel transistors.

5. The circuit of claim 1, wherein the comparator includes internal hysteresis.

6. The circuit of claim 1, wherein the replica bias regulator includes:

an error amplifier comparing a reference signal to a feedback signal and providing an output.

7. The circuit of claim 1, wherein the replica bias regulator includes:

a first transistor having a drain coupled with a supply, a gate receiving the output of the error amplifier, and a source coupled with the switch.

8. The circuit of claim 1, wherein the switch is an n-channel transistor.

9. The circuit of claim 1, wherein the feedback circuit includes at least one resistor when the switch is on.

10. The circuit of claim 1, wherein the feedback circuit includes at least two resistors when the switch is off.

11. In an electronic circuit, a method of performing load regulation with a replica bias circuit, comprising:

sensing a level of an output load current; and in response to the sensing operation, altering a feedback resistance in the replica bias circuit;

wherein the altering operation includes bypassing a portion of the feedback resistance if the output load current is low.

12. The method of claim 11, wherein the altering operation includes:

including a portion of the feedback resistance if the output load current is high.

13. A circuit for performing load regulation of an output, comprising:

means for sensing a level of an output load current; and means for altering a feedback resistance in a replica bias circuit responsive to the sensing means;

wherein the means for altering includes means for bypassing a portion of the feedback resistance if the output load current is low.

14. The circuit of claim 13, wherein the means for altering includes:

means for including a portion of the feedback resistance if the output load current is high.

15. The circuit of claim 13, wherein the means for bypassing includes a comparator coupled with a switch.

* * * * *